US005114155A

United States Patent [19]

Tillery et al.

[11] Patent Number: 5,114,155

[45] Date of Patent: May 19, 1992

[54] SYSTEM FOR AUTOMATIC COLLECTION AND DISTRIBUTION OF PLAYER STATISTICS FOR ELECTRONIC DART GAMES

[75] Inventors: Michael L. Tillery; Eugene G. Harlan; John R. Martin; Samuel N. Zammuto; Marcio Bonilla, all of Rockford, Ill.

[73] Assignee: Arachnid, Inc., Rockford, Ill.

[21] Appl. No.: 658,206

[22] Filed: Feb. 20, 1991

Related U.S. Application Data

[63] Continuation-in-part of Ser. No. 539,020, Jun. 15, 1990, abandoned.

[51] Int. Cl.[5] ..... F41J 3/02

[52] U.S. Cl. ..... 273/371; 273/138 A; 273/376

[58] Field of Search ..... 273/371, 376, 416, 138 A

[56] References Cited

U.S. PATENT DOCUMENTS

| | | | |
|---|---|---|---|
| 4,232,295 | 11/1980 | McConnell | 273/138 A X |
| 4,335,809 | 6/1982 | Wain | 273/138 A X |
| 4,521,014 | 6/1985 | Sitrick | 273/DIG. 28 X |
| 4,572,509 | 2/1986 | Sitrick | 273/DIG. 28 X |
| 4,582,324 | 4/1986 | Koza et al. | 273/138 A |
| 4,636,951 | 1/1987 | Harlick | 273/138 A X |
| 4,652,998 | 3/1987 | Koza et al. | 273/138 A X |
| 4,761,684 | 8/1988 | Clark et al. | 273/138 A X |
| 4,793,618 | 12/1988 | Tillery et al. | 273/376 |
| 4,824,121 | 4/1989 | Beall et al. | 273/376 |
| 4,960,983 | 10/1990 | Inoue | 235/449 |
| 4,976,441 | 12/1990 | Kim | 273/376 |

*Primary Examiner*—William H. Grieb
*Attorney, Agent, or Firm*—Leydig, Voit & Mayer

[57] ABSTRACT

A method and apparatus for conducting dart leagues or tournaments wherein players participate at multiple remote locations. The present invention provides a plurality of remotely located electronic dart games connected via a communication medium to a central control device enabling bidirectional communication between the central control device and the plurality of remotely located electronic dart games. The invention in a preferred embodiment enables players to participate in a dart league or tournament from various locations, however, it is possible for the plurality of electronic dart games to be at one location. Each electronic dart game is capable of receiving data from and transmitting data to player cards. Each dart game player has a player card that identifies a player to a respective dart game, and the player card also stores player data and game statistics. A master dart game is located at each remote location. The master dart game interfaces with each of the non-master dart games at that remote location. The master dart game stores statistical data received from the non-master dart games. The central control device polls each master dart game at each remote location at a predetermined time so as to upload and assimilate current statistical data from each remote location. The central control device then calculates the current standing of each player and downloads player standings to each remote location. The standings of the players can be displayed at each remote location via a portable display.

30 Claims, 16 Drawing Sheets

MASTER MODEM MANAGER

SERISRII.C TELECOMMUNICATIONS CONTROL PROGRAM

MAIN:

SERISR11.C

Main:

Initialize clock interrupt ISR.
Initialize serial port (modem) ISR.
Set modem to auto answer.

Look on foreground TASK.

FIG. 3e

SERISR11.C

```
Received Data ISR:
    Get incoming character into buffer.

    If "password was not received"and connected
        If more than 50 CHAR received
          Hang up phone, break.
        Append CHAR to sys password.
        If password is valid
          Set flag password received.

    Else
        If CHAR is "C"
          If data in master or slaved
            Send first block, transfer in progress
          Else
            Hand up phone.
        If CHAR is ACK
          If transfer in progress
            If more data in master or slaves
                        send another block
            Else
                        send last block acknowledge.
        If CHAR is NAK
          If transfer in progress
            Abort call.
            Hang up phone.
          Else
            Resend last block sent.

    If CHAR is EOT
        If transfer in progress
          Disable interrupts.
          Up date pointers for buffer in nvrm.
          Enable interrupts.
          Send EOT to operator.
          Send BYE to operator.

    Return
```

FIG. 3f

SATELLITE NET MANAGER

NET I.C.: WAIT FOR PACKET FOR THIS NODE

NET7.C: WAIT FOR PACKET FOR THIS NODE

```
            Initialize net port

Begin:      While packet not received
                Wait for packet
            If packet is for this node
                Send ACK packet
                Process_Packet
            Else
                Ignore packet
            Loop on Begin
```

FIG. 4d

90 Net Packet Data Dictionary
preliminary 8/8/90
revised 1/25/91

```
packet                  =   packet_header +
                            data

packet_header =         start_byte +
                            destination_node_id +
                            source_node_id +
                            command +
                            packet_length_low_byte +
                            packet_length_high_byte +
                            check_sum_low_byte +
                            check_sum_high_byte +
                            sys_password

sys_password            =   arachnid_id +
                            user_defined_password

arachnid_id             =   # the Arachnid, Inc. trademark
                        =   <*** ARACHNET (c)1990 ***>

user_defined_password   =   # the password setup by the
                              operator
                        =   8{byte}8

data                    =   0{byte}4096

start_byte              =   # marker for start of packet
                        =   <A>
                        =   1{byte}1
```

FIG. 5a

```
destination_node_id   =   # where packet is going
                      =   node_id_number
                      =   1{byte}1

source_node_id        =   # who sent packet
                      =   node_id_number
                      =   1{byte}1

node_id_number        =   # id numbers for nodes
                      =   0..255
                      =   0xFF          all nodes
                          0xFE          master node
                          0x01..0xEF    slave nodes
                          0x00          reserved

command               =   # packet processing commands
                      =   2{byte}2
                      =   command_type
                      =   NET_NULL  |
                          NET_ACK   |
                          NET_TIME_DATE  |
                          NET_ARE_YOU_THERE  |
                          NET_SEND_ME_STAT_RECORD  |
                          NET_PRINT  |
                          NET_CONSOLE  |
                          NET_EX_COMMANDS

  command_type        =   0x00          reserved
                          0x01..0x7f    bitwise commands
                                        Bitwise commands allow
                                        nesting of several
                                        commands. If bit 7 of
                                        the command byte is 0,
                                        the command is a
                                        bitwise command.
                          0x80..0xEF    extended commands
                          0xFF          reset to all nodes
```

FIG. 5b

| | | | |
|---|---|---|---|
| | | 0xFE | reset node |
| | | 0xFD..0xF0 | reserved |
| NET_ACK | = | 0x01 | ACK "packet acknowledge" packet |
| NET_NAK | = | 0x02 | NAK "re-send last packet" packet |
| NET_TIME_DATE | = | 0x04 | packet contains time & date |
| NET_ARE_YOU_THERE | = | 0x08 | "Node, are you there?" packet |
| NET_SEND_ME_STAT _RECORD | = | 0x10 | send one statistic record |
| NET_PRINT | = | 0x20 | data is for node's printer |
| NET_CONSOLE | = | 0X40 | data is for node's crt |
| NET_EX_COMMANDS | = $ | Extended commands are for as yet undetermined use. | |
| | = $ | Extended commands. | |
| | = | 0x80..OxEF | |
| packet_length_low_byte | = | $ total length of packet including header 1(byte)1 | |
| packet_length-high-byte | = | 1(byte)1 | |
| check_sue_low_byte | = | # CRC for all bytes in packet | |
| | | # To compute checksum: | |
| | | # | 1) put zeros in check sum fields of packet |
| | | # | 2) call CRC function |
| | | # | 3) put CRC value into checksum fields |
| | | # | 4) send packet |
| | | # | |
| | = | 1(byte)1 | |

FIG. 5c

| | | |
|---|---|---|
| check_sum_high_byte | + | 1(byte)1 |
| time | = | # current time of day in ASCII |
| | = | hour + minutes |
| hour | = | 2(byte)2 |
| | = | 1..23 |
| minutes | = | 2(byte)2 |
| | = | 0..59 |

FIG. 5d

SYSTEM FOR AUTOMATIC COLLECTION AND DISTRIBUTION OF PLAYER STATISTICS FOR ELECTRONIC DART GAMES

CROSS-REFERENCE TO RELATED APPLICATION

This application is a continuation-in-part application of U.S. application Ser. No. 07/539,020, filed Jun. 15, 1990, now abandoned.

FIELD OF THE INVENTION

The present invention relates generally to collection and distribution of data from remotely located electronic dart games, and more particularly to a method and apparatus for conducting either dart league or tournament play.

BACKGROUND OF THE INVENTION

Heretofore, manually conducting either dart leagues or tournaments has been very hectic and involves time consuming operations. Charting participating players, writing match cards, computing players' scores, collecting players' scores, and calculating each player's current standing are just a few of the major areas for problems and mistakes associated with operating a dart league or tournament. The added factor of human error can increase the severity of these problems even more.

In tournaments, charting participating players is prone to errors, not because the charting is complicated and hard to follow, but because of the rush and confusion surrounding the charting process. Players typically must manually fill out a registration chart. This requires players to manually write his or her name into small spaces and locate opposing teams. The occurrence of human error is very likely in this situation due to players being rushed, several people working on one chart, difficulty in reading handwriting on cards and charts, and questions being asked during charting by officials and players.

During league play, players must accurately keep track of each others score while also concentrating on their own league performance. Players typically compute each others score and keep track of these scores on a nearby chalkboard or the like. Such a technique is unorganized, confusing and prone to human error.

After the completion of a match, each player's score must be reported, assimilated with the scores of other players, and then computed to determine the present standing of each player in the league. The collection, computation, and distribution of this statistical data typically requires a large amount of time and effort by many people. Routemen must travel to all the remote locations and collect the statistical data, then people located at a central office must calculate the current results of the league standings from the statistical data. After the current results of the league standings have been calculated, this information must be distributed to each remote location. This whole process requires a great deal of time and is very expensive.

Contemporary computerized dart games may help to reduce some of the problems associated with league or tournament play. Computerized target games are well-known as exemplified by U.S. Pat. No. 4,793,618 to Tillery et al. and U.S. Pat. No. 4,824,121 to Beall et al. Such electronic games automatically compute and display players' scores. Tillery et al. discloses a self-scoring electronic target game with a video display for providing instructions and various game conditions. Beall et al. discloses a dart game with a video display that can be programmed to present a customized display according the desires of the owner or lessee of the dart game.

While computerized dart games may help with the scoring problems associated with tournament play, these games still fail to solve many of the other problems associated with large leagues or tournaments.

OBJECTS AND SUMMARY OF THE INVENTION

Accordingly, it is a primary object of the present invention to provide a method and apparatus for automating data transfer and management of a dart league or tournament.

In that regard, it is an object of the present invention to facilitate the management of a dart league or tournament, increase accuracy of transferred game data, and lower overhead cost by increasing management efficiency.

Another object of the present invention is to eliminate human error which is a factor with manually collecting and calculating statistical data.

An additional object of the invention provides for varying the programming of each remotely located electronic dart game from a central location without the assistance of routemen. A central control device can download new programming to each remotely located electronic dart game via a communication medium, such as a transmission link.

Another object of the present invention enables a player to obtain a hard copy printout of his statistics. The present invention records all play-by-plays of each player, and a player may later retrieve statistics derived from this information if desired.

A further object of the present invention is to provide a dart league or tournament system which is more convenient for the players. More players are able to participate in a dart league or tournament implementing the present invention because players can play from whichever remote location is more accessible to each player. The present invention is also more convenient for the players by eliminating the necessity for players to compute their current score; all the players have to do is throw their darts and enjoy the game.

Briefly, the present invention provides a plurality of remotely located electronic dart games connected via a communication medium to a central control device enabling bidirectional communication between the central control device and the plurality of remotely located electronic dart games. The invention in a preferred embodiment enables players to participate in a dart league or tournament from various locations, however, it is possible for the plurality of electronic dart games to be at one location. Each electronic dart game is capable of receiving data from and transmitting data to player cards. Each dart game player has a player card that identifies a player to a respective dart game, and the player card also stores player data and game statistics. A master dart game is located at each remote location. The master dart game interfaces with each of the non-master dart games at that remote location. The master dart game stores statistical data received from the non-master dart games. The central control device polls each master dart game at each remote location at a predetermined time so as to upload and assimilate current statistical data from each remote location. The central control device then calculates the current standing of each player and downloads player standings to each remote location. The standings of the players can be displayed at each remote location via a portable display.

Other objects and advantages of the invention will become apparent from the following description and the accompanying drawings.

BRIEF DESCRIPTION OF THE DRAWINGS

FIGS. 3*e* and 3*f* are a summary of a program for controlling the master dart games.

FIG. 4*d* is a summary of a program for controlling the non-master dart games.

FIGS. 5*a*–5*d* are a possible data dictionary utilized in communicating data between the central control device (CCD) and the remotely located master and non-master dart games.

While the invention will be described in connection with the preferred embodiments, there is no intent to limit it to those embodiments. On the contrary, the intent is to cover all alternatives, modifications and equivalents included within the spirit and scope of the invention as defined by the appended claims.

DESCRIPTION OF THE PREFERRED EMBODIMENTS

Figure 1:
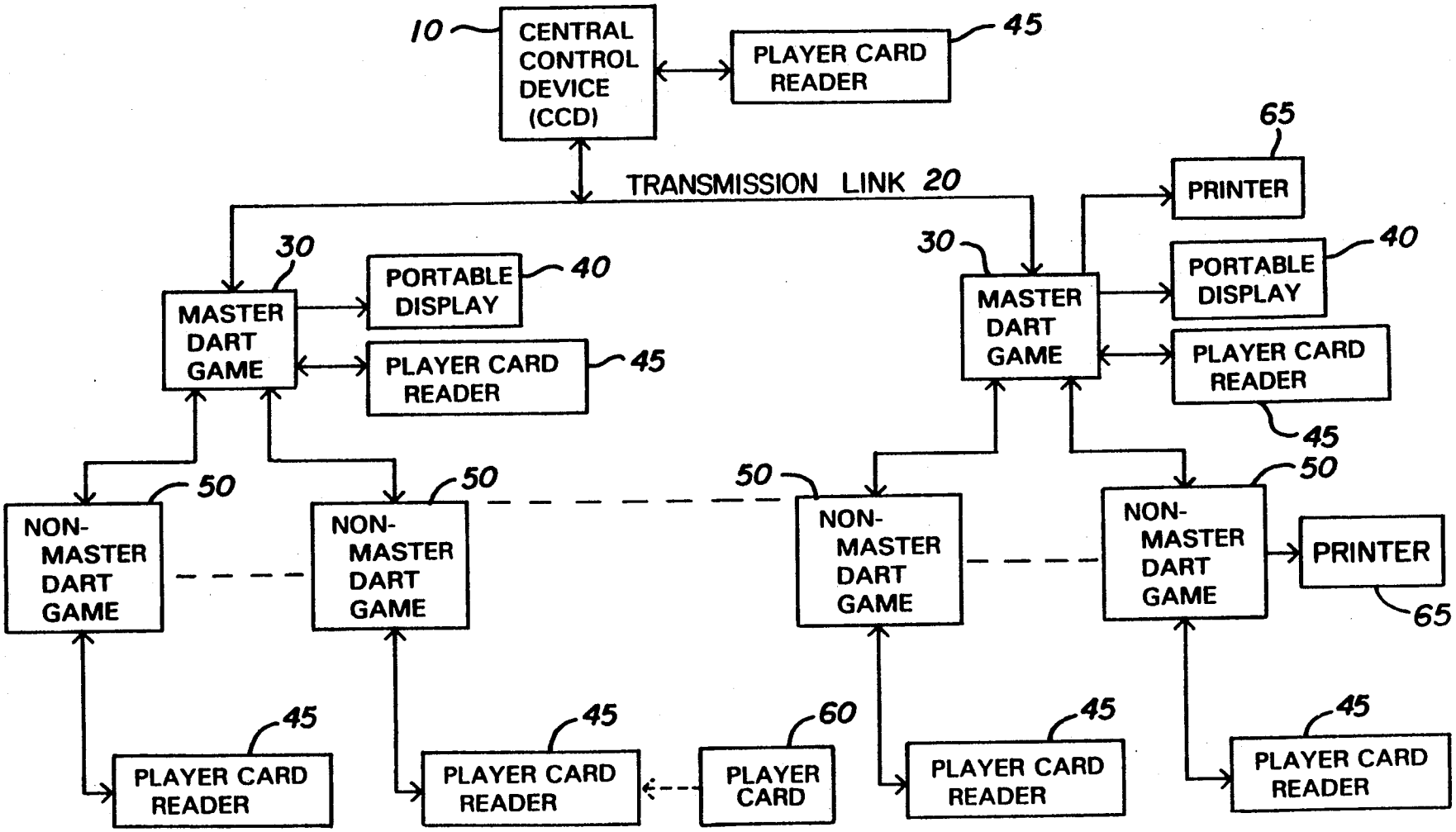
FIG. 1 is a block diagram of a preferred embodiment of the present invention illustrating two remote locations with a master dart game at each remote location. The block diagram, however, is intended to depict that a plurality of remote locations can be connected to a transmission link, each remote location having a master dart game and a plurality of non-master dart games.

Turning now to the drawings, FIG. 1 is a block diagram of the present invention. A central control device (CCD) 10 is a computer system located remotely from the plurality of locations where league or tournament players participate. The CCD 10 includes typical features of a computer system, such as a display, a keyboard, a modem, a printer, and the like. The CCD 10 serves to unite all of the remotely located electronic dart games and process all statistical data of a dart league or tournament. While in a preferred embodiment the invention enables players to participate in a dart league or tournament from various locations, it will be readily appreciated that a plurality of electronic dart games can be at one location in another embodiment.

The CCD 10 maintains two-way communication with each of the remotely located electronic dart games via a communication medium, such as a transmission link 20. The CCD 10 includes a modem which enables the CCD 10 to communicate with each of the remote locations via the transmission link 20. In a preferred embodiment, the transmission link 20 is a conveniently existing cable system such as the lines of a public or private telephone system or the like. In an embodiment wherein all of the electronic dart games are positioned at one location, the transmission link can be simply wires that electronically interlink the CCD 10 to the electronic dart games.

To facilitate multi-location leagues or tournaments, at each remote location will be provided with at least one master dart game 30 and a portable display 40. Depending on the number of participants at each remote location, the number of non-master dart games 50 at each remote location will vary. If a transmission link 20 is not used, then non-master dart games 50 may simply be used and data will be physically transferred using player cards 60 as the communication medium.

The master dart game 30 has all the features of a standard electronic dart game, but it also includes a more sophisticated controller program, a modem, a portable display interface, a player card reader, and multiple non-master dart game interfaces. In a preferred embodiment, the master dart game 30 is the only dart game that communicates directly with the CCD 10 via the transmission link 20. All the non-master dart games 50 at each remote location communicate with the master dart game 30. This setup is more efficient because the CCD 10 only has to communicate with one dart game at each location in order to transmit data to and/or acquire statistical data from each remote location. This cuts down on the time required to transfer data via the phone lines.

In accordance with the present invention, players participate in a dart league or tournament from various remote locations and the transfer of game statistics and player data is automated. In the preferred embodiment, each player is provided with a player card and the electronic dart games are capable of accepting the player cards 60. The player cards 60 may be any portable, data storage device. For instance, the player card 60 may be a noncontact integrated circuit (IC) card as disclosed in U.S. Pat. No. 4,960,983 to Inoue. Each participant in the dart league or tournament has a player card 60 that identifies that player and stores player data and game statistics.

Both the master dart games 30 and the non-master dart games 50 include player card readers 45. The player card readers 45 provide means for receiving player data and game statistics from the player cards 60, and also provide means for transmitting new player data and game statistics to the player cards 60. If IC cards are utilized as player cards 60, then the player card reader 45 would be an IC card reader/writer.

If player cards 60 are not used, then a different type of player data input will be accommodated. For example, a keyboard may be provided whereby a player inputs an identification code so that the respective dart game can identify the player. A player identification code is not simply a numerical code that could be guessed by a hoaxer, but a combination of letters and numerals. Such an embodiment is not preferred, however, because it does not provide the convenience and advantages available with the player cards 60. For example, the player cards 60 are capable of storing player data, a feature that is not available wherein players simply key in their respective identification codes.

According to the preferred embodiment, each player receives a player card 60 that identifies one respective player. The player card 60 may contain additional information such as available game credits, game restrictions or setup, and player standings. This information is transferred to the respective electronic dart game during play and is later uploaded to the CCD 10 for assimilation of data. Similarly, new player data and game statistics may be downloaded to a player card 60.

The player cards 60 enable dart league or tournament players to participate from various remote locations because the player card readers 45 identify each player by his or her player card 60. All game statistics and player data is later uploaded to the CCD 10. As a result, a player could have his or her player card 60 updated by an electronic dart game at another remote location, wherein that dart game has a player card reader 45 and is interlinked to the CCD 10 via the transmission link 20.

If no transmission link 20 or master dart game 30 is available, game statistics and player data may be collected by a routeman, or routemen, utilizing player cards 60 as operator cards. In such an arrangement, the routemen have special player cards 60 that are identified by the electronic dart games 30 or 50 as operator cards, wherein cumulative game statistics and player data is downloaded to the operator cards which are physically transported to the location of the CCD 10 to be read. Although this arrangement is not as convenient as the illustrated preferred embodiment, it does provide an effective alternative if needed.

Players register for a dart league or tournament by inputting the information at the location of the CCD 10. By registering at the location of the CCD 10, the player's name may also be entered so that the CCD 10 can associate the identification code of the player card 60 with the person's name. It may be possible to register players at the remote locations, but personal information corresponding to the issued player card 60 would have to be entered later to the CCD 10. Of course, an input apparatus may be devised for inputting player information at the remote locations. In that regard, the electronic game may even utilize Arachnid, Inc. Spider Writer® input technique as disclosed in U.S. Pat. No. 4,824,121 to Beall et al. in order to input personal information on the players.

Figure 2:
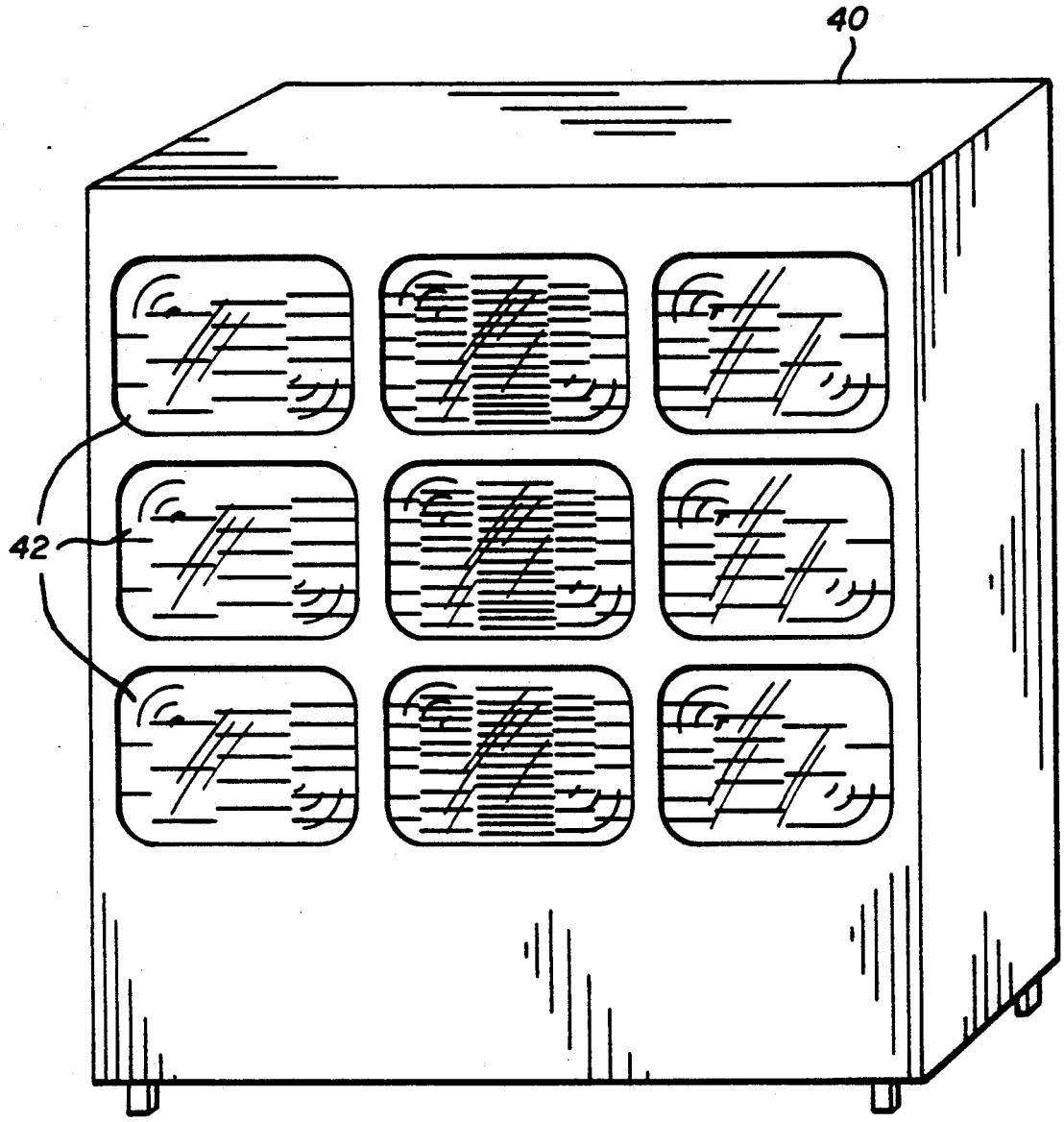
FIG. 2 illustrates a preferred embodiment of the portable display which may be utilized in the present invention.
Figure 3A:
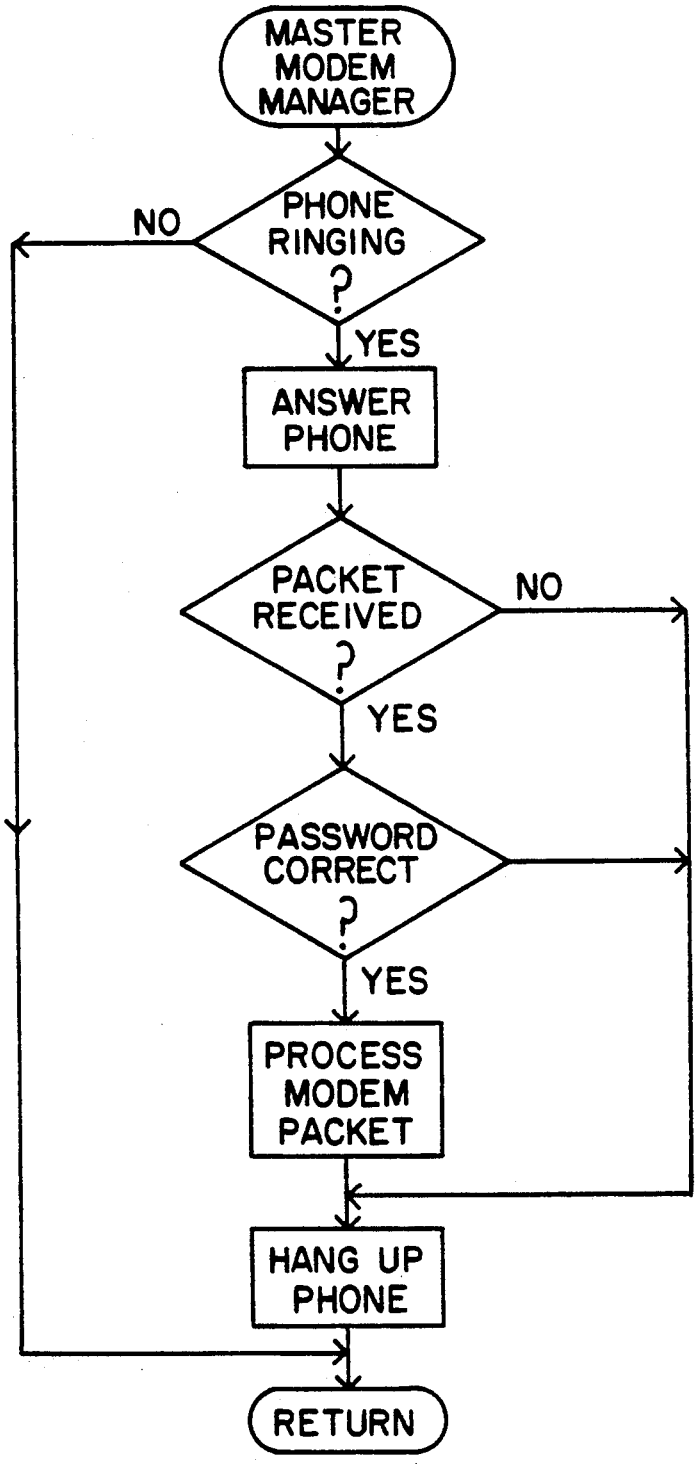
FIGS. 3*a*–3*d* are flow chart diagrams illustrating a process for controlling the master dart games.
Figure 3B:
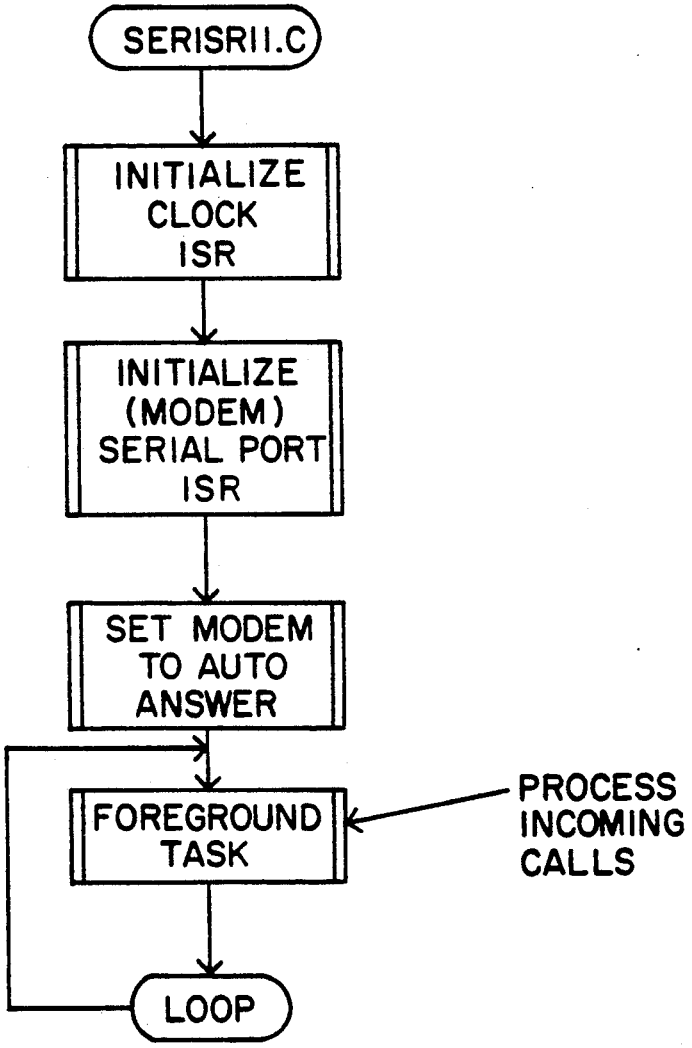
Figure 3C:
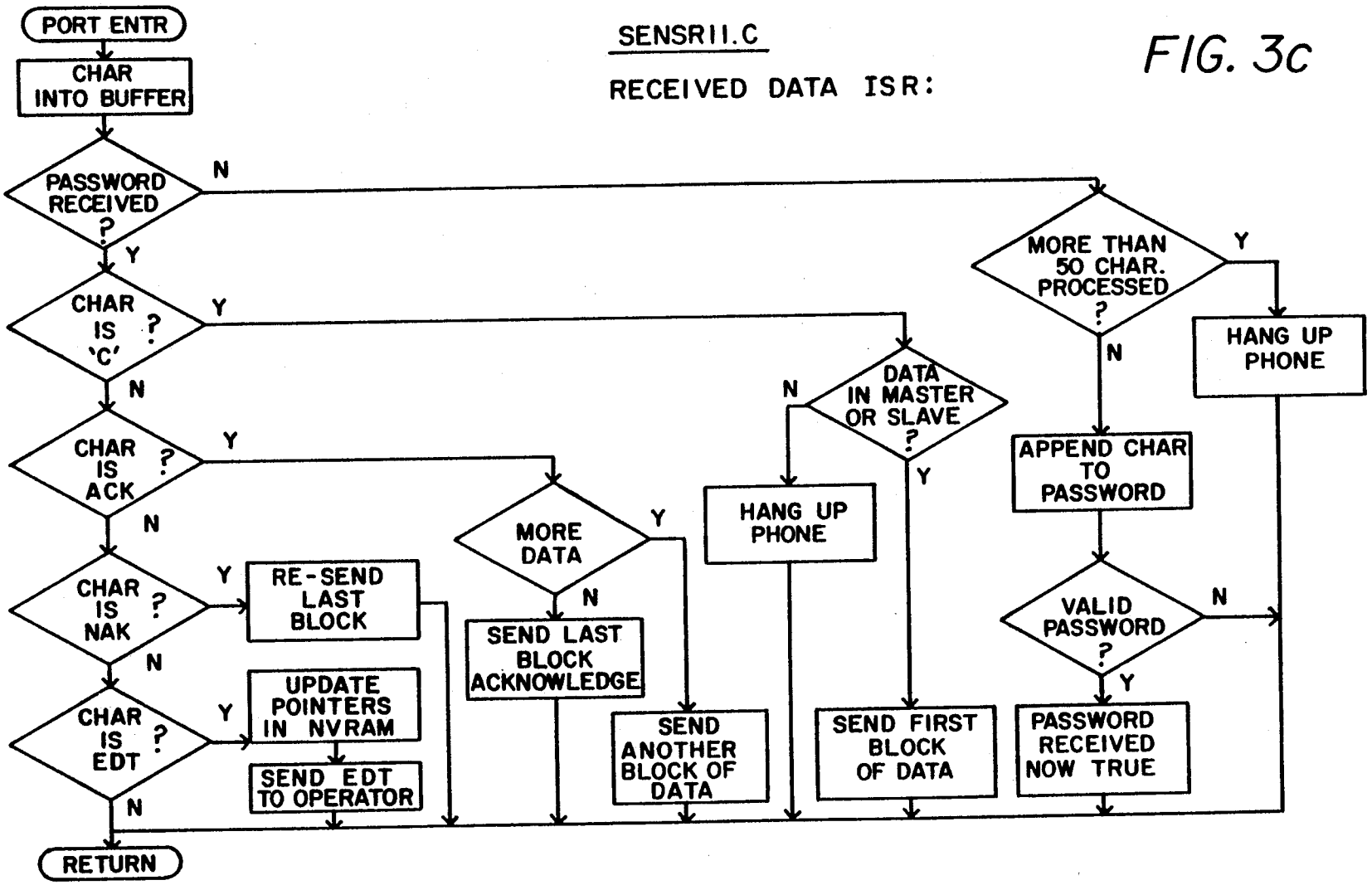
Figure 3D:
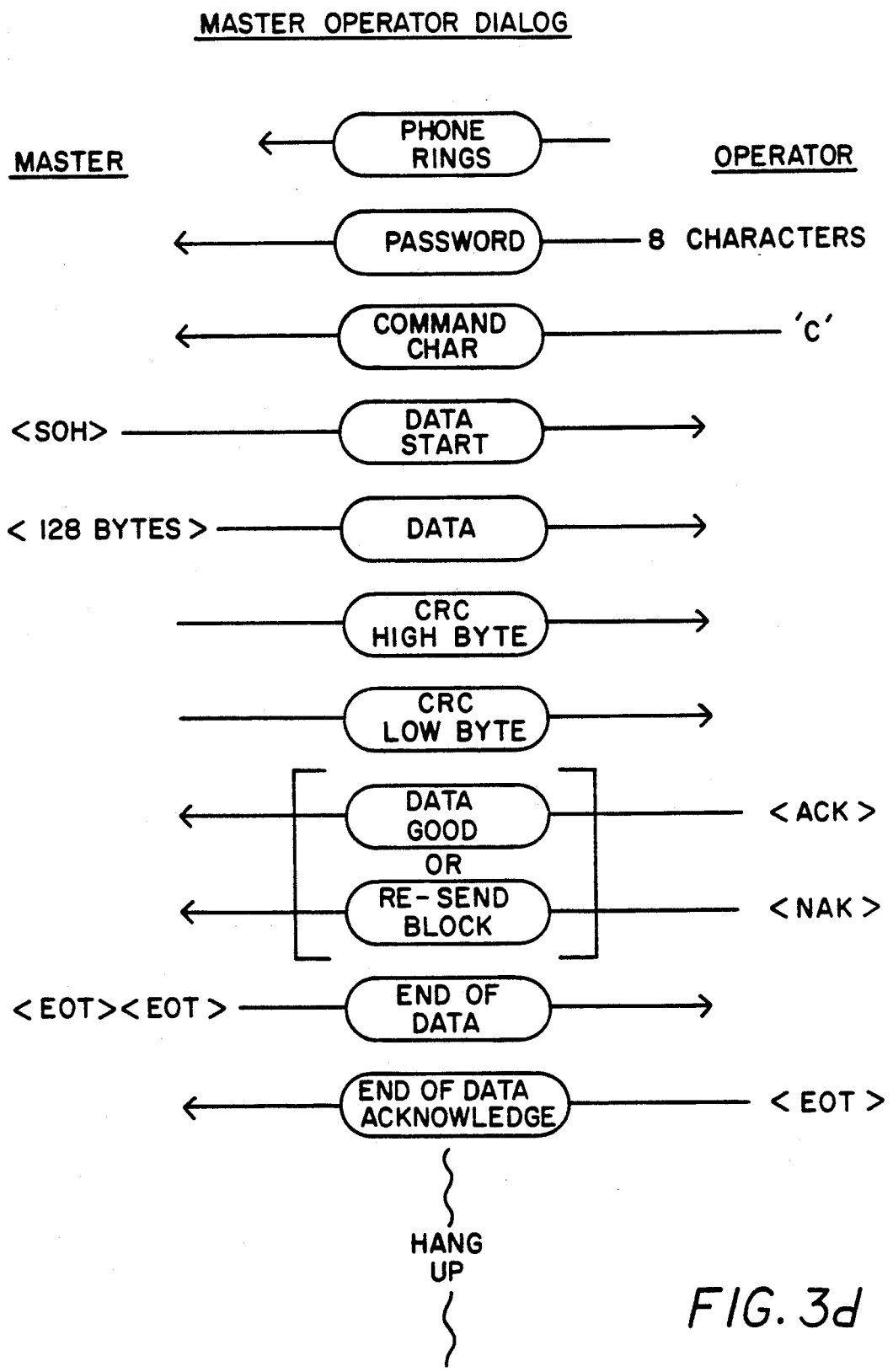

After all players are registered, the CCD 10 computer will pair up teams, downloading the information to the master dart game 30 via the transmission link 20 to be displayed on the portable display 40. The portable display 40 can be a type of video display. A preferred embodiment of the portable display 40 is illustrated in FIG. 2. The portable display 40 may consist of a single terminal or an array of terminals 42 housed vertically in a portable, rugged cabinet. The display 40 stores and displays information without continuously updating, and provides a pleasing display accessible to a large number of players. Multiple terminals 42 is a preferred embodiment of the portable display 40 because this embodiment allows simultaneous display of different images on each terminal, or one large image displayed on the plurality of closely located terminals.

The paired up teams play each other at any one of the electronic dart games that is interlinked to the CCD 10. The master dart games 30 and non-master dart games 50 include visual displays for providing players with directions, game scores, and the like. Electronic dart games similar to those disclosed in Tillery et al. (U.S. Pat. No. 4,793,618) are utilized as non-master games 50, but the non-master dart games 50 include the player card readers 45 and also have means for interfacing with a master game 30.

After participant players have inputted their player cards 60 into the respective dart game, each of the non-master games 50 and the master dart game 30 continuously display throughout a match players' names, players' current scores, and information instructing players. All the players have to do is keep their mind on the game and throw their darts.

At the end of each match, the respective non-master dart game 50 feeds the results of the match to the master dart game 30. The participating players also insert their player cards 60 into the respective player card reader 45 at the end of each game in order for their player cards 60 to be updated. The master dart game 30 stores the results in memory and then displays the results of each match on the portable display 40. The portable display 40 continuously displays the results of all matches, updating the display each time new data is received. This process is repeated for each match until the end of play for that specific period (for example, when a tavern hosting the match closes).

At a designated time, such as after play ends for that day, the CCD 10 polls the master dart game 30 at each location and uploads the statistical data from each master dart game 30 to the CCD 10. After the CCD 10 has assimilated all the statistical data from each master dart game 30, the CCD 10 calculates the current standings of all the players and then downloads this information to each of the master dart games 30. Current standings can be displayed on the dart games at the remote location or on a portable display 40 where utilized. In this way, players at every remote location know the periodic standings of players at other remote locations. The players at each remote location are also informed of the current standings of all players at their specific location.

The CCD 10 can be programmed to poll each of the master dart games 30 during off-hours. This period of time usually occurs when an establishment hosting the dart league or tournament is closed. The CCD 10 can poll the master dart games 30 during off-hours to insure that the transfer of statistical data does not interfere with the ability of an establishment hosting the dart league or tournament to utilize their own phone lines. Furthermore, since the present invention is designed to poll the master dart games 30 during off-hours, the present invention does not require the use of dedicated phone lines.

FIGS. 3*a*–3*d* are flow chart diagrams illustrating an example of one process for controlling the master dart games 30. FIGS. 3*e* and 3*g* further illustrate a brief summary of an example of a program for controlling the master dart games 30.

Figure 4A:
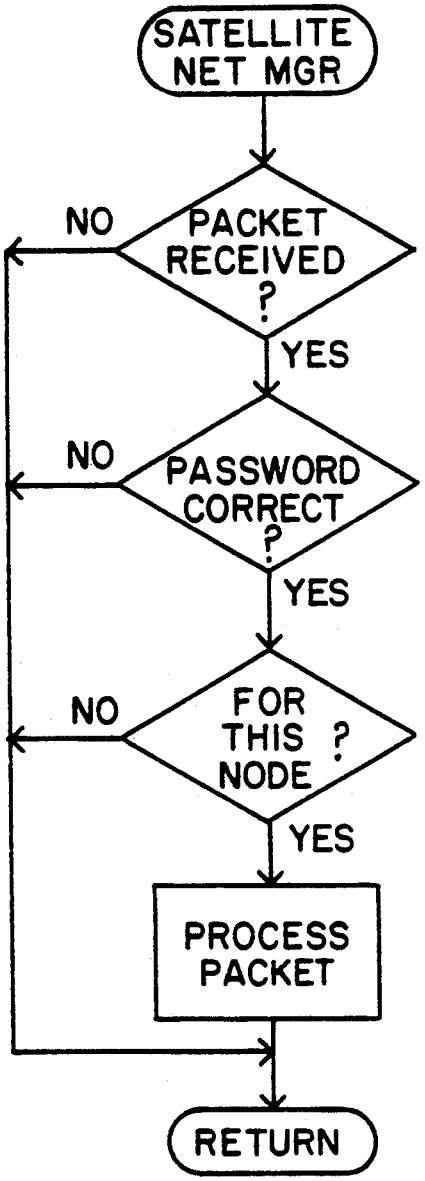
FIGS. 4*a*–4*c* are flow chart diagrams illustrating a process for controlling the non-master (slave or satellite) dart games.
Figure 4B:
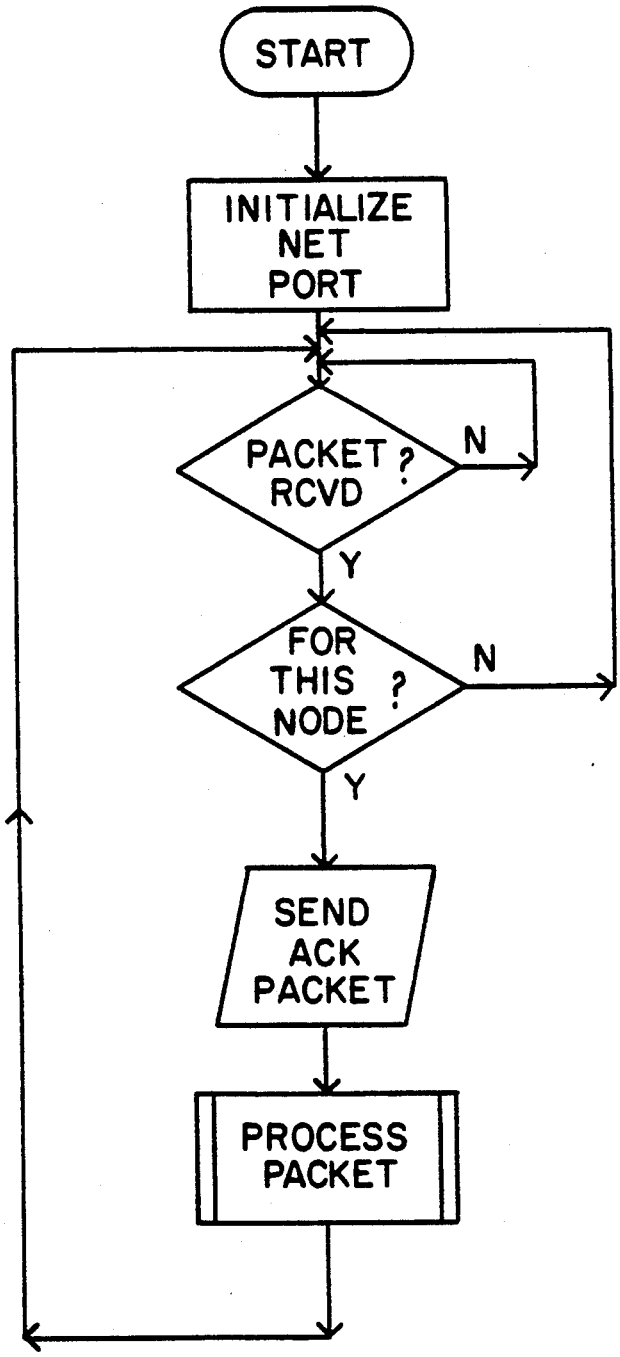
Figure 4C:
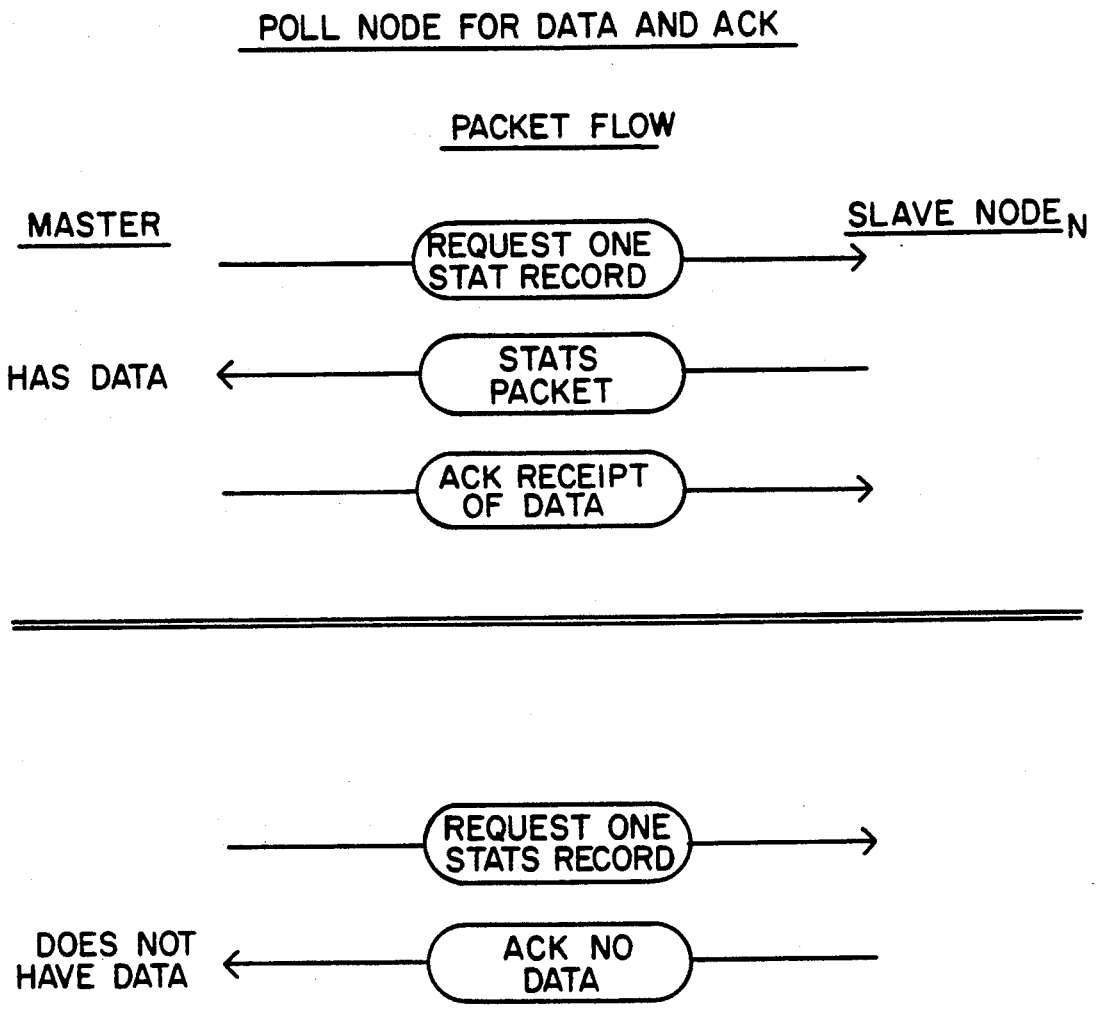

Similarly, FIGS. 4*a*–4*c* are flow chart diagrams of a process for controlling the non-master dart games 50. FIG. 4*d* is a brief summary of a program routine for controlling the non-master dart games 50.

FIGS. 5*a*–5*d* illustrate a possible data dictionary that can be utilized to communicate data between the CCD 10 and the remotely located master games 30 and the non-master games 50. It should be made clear that the routines illustrated in FIGS. 3–5 are only examples and are not stated or implied to be the only possible control routines that can be utilized successfully in the present invention.

For use at a tournament, registration is at a central location. An official assigns a unique player card 60 to each player and then inputs the players names and addresses into the CCD 10. The CCD 10 then correlates each unique player card 60 with its designated player. After all registrations are inputted, the CCD 10 makes the tournament charts of a size needed depending on the number of players involved. Player names are randomly placed on the charts. The "charts" are then displayed by downloading the information via the transmission link 20 to the master dart games 30 which transfer the data to the portable displays 40 so the players can see when they play and on which dart game (either a master 30 or a non-master game 50).

A player goes to the designated machine and enters his player card 60 into the respective player card reader 45, as does his opponent. Each sanctioned league player carries a player card 60 that enables that person to enter information into the dart game. For example, the information may be: 1) Names of up to 4 team members, 2) Number of games being played, 3) Type of game to be played, and 4) Shooting order of players up to 30 matches. Other information necessary for league play may also be entered. The match is played, after which, the results are transmitted to the master game 30 (if it was a non-master game 50) which transmits to the CCD 10 via the transmission link 20. The CCD 10 receives the results, knowing which player is the winner and which is the loser, and places the winner in a new position on the charts and the loser in his new position unless he is now out of the tournament. The charts on the portable displays 40 are then updated via the transmission link 20, to the master games 30, and to the portable displays 40 so that the players still in the tournament are able to quickly determine which game their next match is to be played on. This continues until there is only one player left who is the winner of the tournament.

According to one aspect of the present invention, each remotely located electronic dart game has a control system arranged to load new control programming received from the CCD 10. This arrangement enables new game programming and control programming to be loaded into the remotely located dart games without the assistance of a routeman. Downloading new programs into electronic games located at remote locations is well-known. Such downloading technology is exemplified by U.S. Pat. No. 4,335,809 to Wain. Such a process allows programming of remote electronic dart games to be quickly, conveniently, and cost effectively altered should the need arise. As an alternative, the player card 60 (operator card) may be used to setup the electronic dart games. For instance, one dart game is setup manually and the setup instructions are downloaded to the operator card 60. Another dart game may be setup later by simply uploading the setup instructions from the operator card 60 to the dart game to be setup.

Another feature of the present invention allows a player to receive a hard copy printout of his statistics. The CCD 10 stores all statistical data uploaded to the CCD 10 from each of the remote locations, including each player's play-by-play. Each electronic dart game 30 and 50 may include a printer 65 that enables a player to receive a hard copy of his statistics after entering his personal player card 60 and requesting a printout. The printer 65 may be internal or external to the dart game 30 or 50. If the player desires global information, or information not available on location, then that information can be downloaded to that specific location during the next polling period after the CCD 10 downloads the requested statistical data to the designated remote location. In this way, a player may obtain a hard copy printout of his statistics from any remote location having an electronic dart game 30 or 50 that is interlinked to the CCD 10.

We claim as our invention:

1. A method of conducting dart leagues or tournaments utilizing a plurality of electronic dart games, each dart game having means for receiving, storing and transmitting data, said method further utilizing a central control device (CCD) having means for processing, inputting, storing and outputting data, said method comprising the steps of:

connecting the plurality of the electronic dart games to the central control device via a communication medium;

inputting data on each player into the central control device via the inputting means; and communicating bidirectionally between the central control device and the plurality of electronic dart games via the communication medium.

2. The method of conducting dart leagues or tournaments as set out in claim 1, wherein the plurality of electronic dart games are situated at one or more locations remote from the central control device.

3. The method of conducting dart leagues of tournaments as set out in claim 2, each dart game further comprising means for displaying data, said method further comprising the steps of:

recording play-by-play of each player automatically via the game storing means upon impact of a dart thrown by a player striking a dart board on said player's respective dart game;

calculating a score of each player resulting from a dart thrown by a player striking a respective dart board of the player;

displaying at each location current scores of every player participating at that location; and polling each remote location by the central control device via the communication medium at a predetermined time in order to upload data from each remote location and process the data.

4. The method of conducting dart leagues or tournaments as set out in claim 2, said method further comprising the step of outputting from the central control device to each remote location current data regarding player standings, statistics of players and team standings.

5. The method as set out in claim 1, said method further comprising the step of providing each player with a player card that identifies the player and stores player data and game statistics, and wherein the communication medium is manual transportation of the player cards.

6. The method as set out in claim 1, wherein the communication medium is provided by electrical wires that enable bidirectional communication between the central control device and the plurality of electronic dart games.

7. The method as set out in claim 1, wherein the plurality of electronic dart games are situated at one or more locations remote from the central control device, and the communication medium is provided by telephone lines.

8. A method of conducting dart leagues or tournaments utilizing a plurality of electronic dart games, each dart game having means for receiving, storing and transmitting data, said method further utilizing a central control device (CCD) having means for processing, storing, inputting and outputting data, said method comprising the steps of:

inputting player data into the central control device;

providing each player with a player card that identifies a respective player and stores player data and game statistics;

inputting player data and game statistics from the player card into the storing means of the electronic dart game via the receiving means of the electronic dart game;

storing game statistics and player data within the storing means of the electronic dart game;

transmitting game statistics and player data via the transmitting means to the player card; and communicating bidirectionally between the central control device and the plurality of electronic dart games via a communication medium, wherein the receiving and transmitting means of the dart games interface with the communication medium.

9. The method as set out in claim 8, wherein manual transportation of the player cards provide the communication medium for the bidirectional communication.

10. The method as set out in claim 8, wherein the communication medium is provided by electrical wires that enable bidirectional communication between the central control device and the plurality of electronic dart games.

11. The method as set out in claim 8, wherein the plurality of electronic dart games are situated at one or more locations remote from the central control device, and the communication medium is provided by telephone lines.

12. The method as set out in claim 11, each dart game further comprising means for displaying data, said method further comprising the steps of:

recording play-by-play of each player automatically via the game storing means upon impact of a dart thrown by a player striking a dart board on said player's respective dart game;

calculating a score of each player resulting from a dart thrown by a player striking a respective dart board of the player;

displaying at each location current scores of every player participating at that location; and polling each remote location by the central control device via the transmitting means at a predetermined time in order to upload data from each remote location and process the data.

13. The method as set out in claim 12, said method further comprising the step of transmitting from the central control device to each remote location via the communication medium current data regarding player standings, statistics of players and team standings.

14. An apparatus for conducting dart leagues or tournaments wherein players can participate at a plurality of remote locations, comprising in combination:

a central control device for computing league or tournament statistics from received player data and game statistics, wherein the central control device (CCD) includes means for processing, storing, inputting and outputting data;

a plurality of remotely located electronic dart games, wherein each dart game includes means for receiving, storing and transmitting data into and out of the dart game; and a communication medium coupling the plurality of remotely located electronic dart games to the central control device and enabling bidirectional communication between the central control device and the plurality of remotely located electronic dart games, wherein the receiving and transmitting means of the dart games and the inputting and outputting means of the CCD interface with the communication medium.

15. The apparatus as set out in claim 9, wherein a player card that identifies the player and stores player data and game statistics is provided to each player, the communication medium being provided by manual transportation of the player cards.

16. The apparatus as set out in claim 14, wherein the communication medium is provided by electrical wires that enable bidirectional communication between the central control device and the plurality of electronic dart games.

17. The apparatus as set out in claim 14, wherein the plurality of electronic dart games are situated at one or more locations remote from the central control device, and the communication medium is provided by telephone lines.

18. In an electronic dart game apparatus especially for use in a dart league or tournament, the combination comprising:

electronic input means for receiving player data and league or tournament player pairings information from at least one external source and game statistics;

storage means within the dart game apparatus for storing the external data and game statistics generated within the dart game; and output means for transmitting the player data and game statistics to a location external to the dart game.

19. The electronic dart game apparatus as set out in claim 18, further comprising:

a printer electronically connected to the dart game apparatus for providing a hard copy printout of game statistics and player data.

20. A system for conducting dart leagues or tournaments wherein players can participate at a plurality of remote locations, said system comprising:

a central control device for computing league or tournament statistics from received player data and game statistics, the central control device including means for processing data, storing data, inputting data, and outputting data;

a plurality of remotely located electronic dart games, wherein each electronic dart game includes means for receiving, storing and transmitting player data into and out of the dart game;

a plurality of player cards for players participating in the league or tournament that are accepted by the receiving and transmitting means of the electronic dart games, wherein the player cards store player data and game statistics; and a communication medium interlinking the central control device with the plurality of remotely located electronic dart games, wherein the receiving and transmitting means of the dart games and the inputting and outputting means of the central control device interface with the communication medium.

21. The system as set out in claim 20, wherein player data and game statistics are bidirectionally communicated between the central control device and the electronic games by utilizing the player cards as the communication medium.

22. The system as set out in claim 20, wherein the communication medium is provided by telephone lines.

23. The system as set out in claim 22, wherein the central control device polls each of the remotely located electronic dart games at a predetermined time, statistical data from each remote location regarding play is uploaded to the central control device and assimilated, the central control device calculates current standing of each player, and then the central control device downloads the current standing of each player to each remote location.

24. The system as set out in claim 23, wherein the central control device polls each of the remote locations during off-hours of establishments hosting the dart league or tournament, whereby transmission of statistical data via the telephone lines does not interfere with the establishments' use of their phone lines.

25. The system as set out in claim 20, wherein the player cards are noncontact integrated circuit (IC) cards.

26. The system as set out in claim 20, further comprising:

means for recording play-by-play of each player automatically upon impact of a dart thrown by a player striking a dart board on the player's respective dart game;

means for calculating a score for each player resulting from a dart thrown by a player striking a respective dart board of the player;

means for displaying at each location current standings of all players and current scores of every player participating at each location; and means for polling each remote location by the central control device at a predetermined time in order to upload all results of play from each remote location and analyzing the results.

27. The system as set out in claim 20, wherein a master dart game is located at each remote location and the central control device communicates with each remote location by solely interfacing with the master dart game located at each remote location, and all non-master dart games at each remote location are individually connected to the master dart game, thereby the master dart game interfaces with each non-master dart game and data is uploaded to the master dart game which in turn uploads the data to the central control device when the master dart game is polled by the central control device.

28. The system as set out in claim 20, wherein the remotely located dart games include means for loading and executing new game programs downloaded from the central control device.

29. The system as set out in claim 20, wherein information regarding game statistics and player data is stored in the central control device, and the information can be retrieved by inputting a request to one of the remotely located electronic dart games to retrieve stored information from the central control device.

30. The system as set out in claim 20, wherein each electronic dart game further comprises:

means for printing a hard copy printout of player data and game statistics.

* * * * *